United States Patent [19]

Reginensi et al.

[11] 4,075,971

[45] Feb. 28, 1978

[54] MOTOR HOUSING FOR A RETRACTABLE PROPULSION UNIT FOR BOATS

[75] Inventors: Jean-Pierre Reginensi, Grenoble; Peter Slack, Echirolles, both of France

[73] Assignee: Alsthom-Atlantique S.A., Paris Cedex, France

[21] Appl. No.: 786,742

[22] Filed: Apr. 11, 1977

[30] Foreign Application Priority Data

Apr. 22, 1976 France ..... 76 11857

[51] Int. Cl.[2] ..... B63H 5/12

[52] U.S. Cl. ..... 115/41 R

[58] Field of Search ..... 114/146, 147, 148, 151; 115/35, 41 R, 41 HT

[56] References Cited

U.S. PATENT DOCUMENTS

| | | | |
|---|---|---|---|
| 2,302,795 | 11/1942 | Noble | 115/41 R |
| 2,699,138 | 1/1955 | Dyer | 114/151 |
| 3,483,843 | 12/1969 | Hawthorne | 115/41 R |
| 3,550,547 | 12/1970 | Pleuger et al. | 114/151 |

*Primary Examiner*—Galen L. Barefoot
*Assistant Examiner*—Jesus D. Sotelo
*Attorney, Agent, or Firm*—Sughrue, Rothwell, Mion, Zinn and Macpeak

[57] ABSTRACT

A device for clamping the motor housing of a retractable propulsion unit for a boat, wherein the housing is clamped by four upper inclined articulated bolts producing thrusts with both vertical and horizontal components and by means of four lower articulated bolts producing horizontal thrusts.

3 Claims, 8 Drawing Figures

10
24
17
7
20
11
13
29
18
21

10
24
13
17
7
20
VIII
11
29
18
21
VIII 24
13
17
7
20
11
29
18
21

MOTOR HOUSING FOR A RETRACTABLE PROPULSION UNIT FOR BOATS

FIELD OF THE INVENTION

The present invention relates to a propulsion unit for a boat or other water craft, the unit being vertically retractable in to a well in the boat.

BACKGROUND OF THE INVENTION

The propulsion unit, whether orientable or not, can be disposed at the lower end of a housing containing the motor unit, this housing sliding vertically upwards in a well inside the boat in order to retract said propulsion unit.

For high-power propulsion units, in which the dimensions of the housing and of its well in the boat are large, appreciable deformation occurs on the walls of said well which make it necessary to leave a relatively large clearance between the housing and its well in order to allow it to slide.

This causes poor lateral stability of the housing in its well and a fairly large leakage of water between the walls of said housing and of the well, whence there is a danger of hindering the access of personnel to the housing.

Preferred embodiments of the present invention mitigate these disadvantages by clamping the sliding housing either in the retracted position which reduces the draft of the boat, or in the extended position which provides sealing between the housing and its well to allow access of personnel to the housing.

SUMMARY OF THE INVENTION

For this purpose, the invention provides a motor housing for a water vessel having a well up and down which the motor compartment and an associated propulsion unit may be moved between an upper retracted position with the housing and the propulsion unit inside the well and a lower, operating position with the propulsion unit projecting out of the bottom of the well wherein the upper part of the motor housing includes first clamping means for clamping the housing in the lower, operating position, the first clamping means comprising inclined articulated bolts arranged to engage the walls of the well to provide a force with both a horizontal component and a vertical component, the vertical component serving to clamp and seal the housing against a shoulder provided in the wall of the well and the horizontal component serving to hold the upper part of the housing in position in the well against lateral displacement therein; and wherein the lower part of the housing includes second clamping means for clamping the housing in both the upper and the lower positions, the second clamping means comprising articulated bolts arranged to engage the walls of the well horizontally to hold the lower part of the housing in position in the well against lateral displacement therein.

The thrust means and locking means are constituted by two link rods one of whose ends is articulated on the end of the piston rod of a hydraulic cylinder, the other end of one of the link arms being articulated on an axis integral with the housing, the other end of the other link rod being articulated on an axis integral with a thrust member that transmits the thrust to the well.

The extending and retraction of the housing in its well could advantageously be effected by hydraulic cylinders.

A non limiting example of the device embodying the invention is described hereinbelow with reference to the accompanying drawings.

DESCRIPTION OF THE PREFERRED EMBODIMENT

Figure 1:
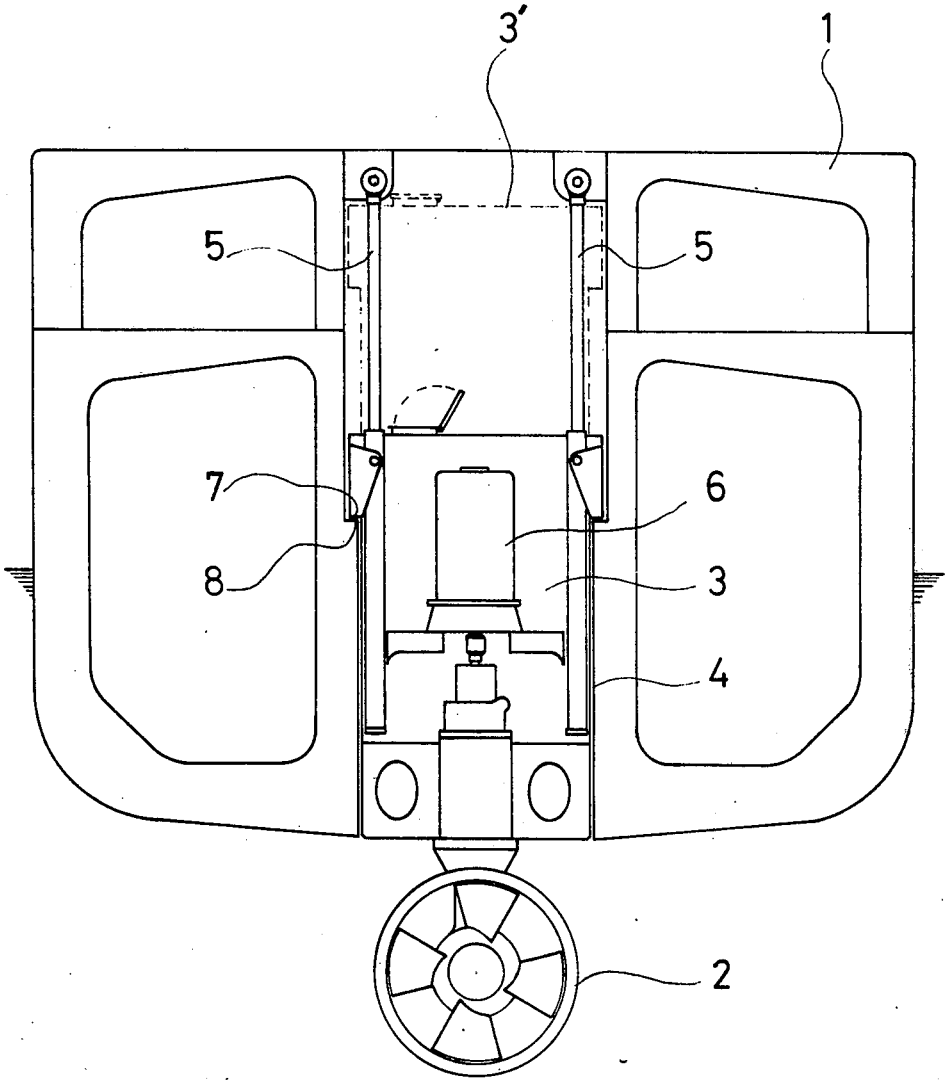
FIG. 1 is a vertical transversal cross-section of a boat's hull equipped with a retractable propulsion unit.

FIG. 1 illustrates a boat 1 with a propulsion unit 2 fixed at the bottom of a housing or compartment 3 which is moveable in a well 4 provided in the boat. The movement is provided by means of hydraulic cylinders 5. The propulsion unit 2 has a motor lodged inside the housing 3. The space above the housing 3 is sealed, in the operating position with the propulsion unit 2 outside the boat as shown in FIG. 1, by a seal 7 which presses against a shoulder 8 of the well 4.

The retracted position 3' of the housing 3 in the well 4 (rest position of the propulsion unit 2) is shown by dotted lines in FIG. 1.

Figure 2:
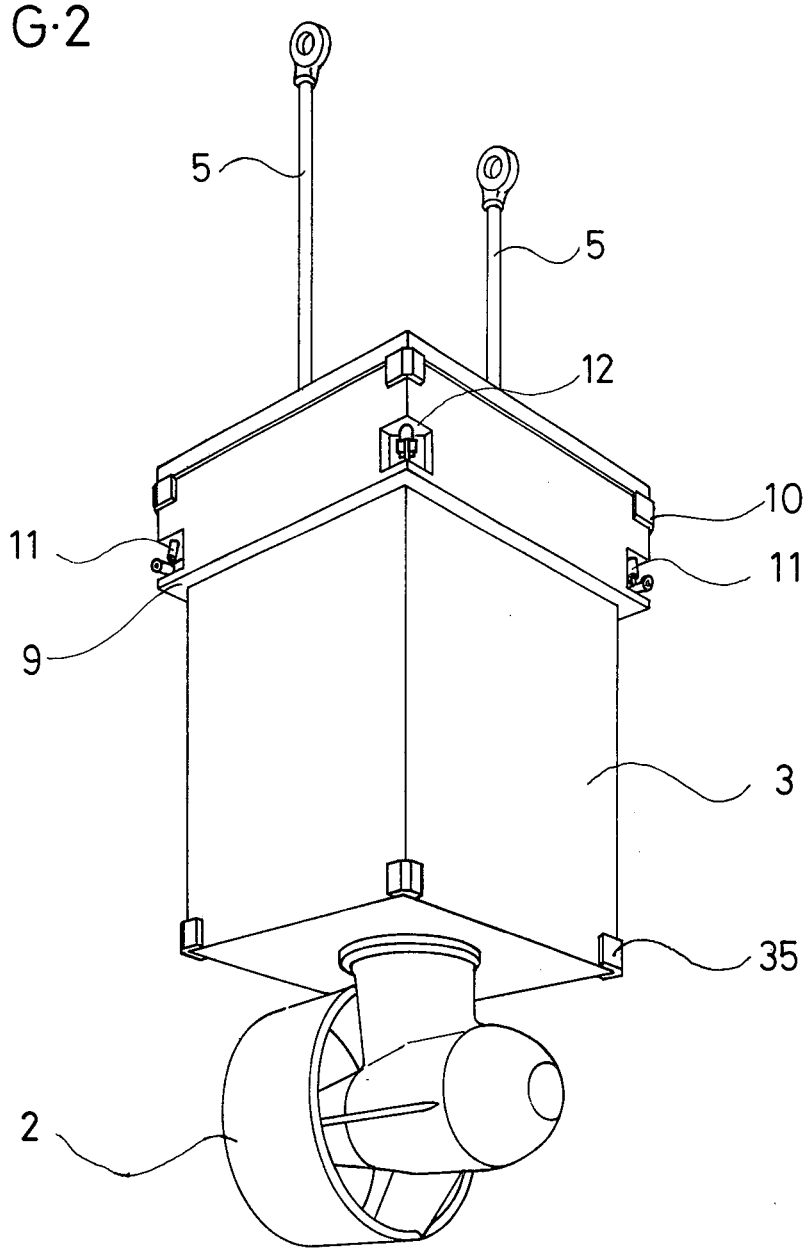
FIG. 2 is a perspective view of the sliding housing carrying the propulsion unit.

FIG. 2 is a perspective view of the sliding housing 3 with the propulsion unit 2, the hydraulic cylinders 5 for sliding the compartment into the rest position and into the operation position, showing shoulder 9 on the housing 3 which provides sealing with the seal 7 by pressing on the shoulder 8 of the well 4.

The sliding housing 3 is provided with guide shoes 10 and slides with play in the well 4 because of the deformations which could occur on the walls of the well 4, taking into account the possibly large dimensions of this well for a ship of heavy tonnage with high propulsive power.

Figure 3:
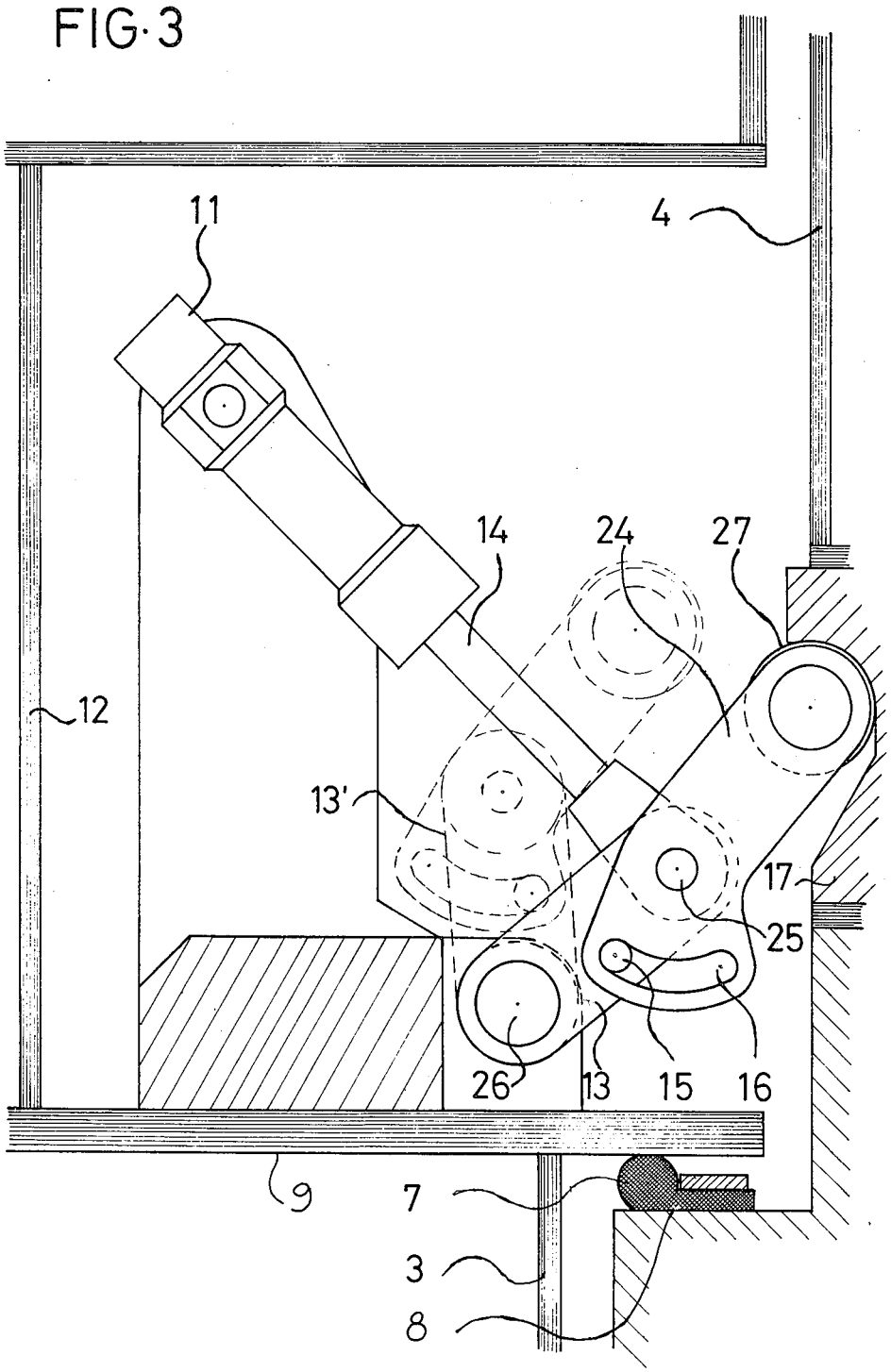
FIG. 3 is a detailed view of a locking bolt for sealing and laterally clamping the housing to the boat well.

In order to seal the space above the housing 3 when it is in the rest position on the seal 7 as well as to ensure its lateral stability, the housing 3 includes four inclined articulated bolts inserted in recesses 12 in each corner of the housing 3, one of these bolts being shown in detail in FIG. 3.

These bolts are articulated on a system constituted by two link rods 13 and 24 articulated on a common axis pin 25. The lower end of the link rod 13 is articulated on a pin 26 fixed solidly to the structure of the housing 3 and the upper end of the link rod 24 carries a roller 27. A double-action hydraulic cylinder 11 is used to operate the bolt and in the embodiment illustrated in FIG. 3, the projecting end of the piston rod 14 of the cylinder 11 being articulated on the same pin 25 which pivotally links the link rods 13 and 24. To limit the angular movement between these two link rods, a stud 15 integral with the link rod 13 slides in a slot 16 formed in an extension of the link rod 24.

This figure shows the mechanism in its retracted position in dotted lines 13 and, in this position, the roller 27 and all the mechanism of the bolt lie inside the recess 12, the housing 3 being free to slide vertically. When the compartment is in the lowered, projected operation position, the cylinder 11 is pressurized in order to extend its piston rod 14, the link rods 13 and 24 thus pivoting about the axis of the pin 26 until the roller 27 comes into contact with a notch 17 formed in the wall of the well 4. Since the piston rod 14 of the cylinder 11 continues its movement, the link rods 13 and 24 pivot simultaneously about the axis of the pin 26 and about the axis of the roller 27 respectively. Thus, the distance between these two axes increases and since the pin 26 cannot move horizontally towards the inside of the housing 3, and since the notch 17 is integral with the well 4, the housing is thus pressed hard against the seal 7, which acts like a spring due to its resilience (it is made of rubber).

When the axis of the roller 27, the axis 25 and the axis of the pin 26 are aligned, the length between the axis 27 and the axis 26 will be a maximum and therefore the seal 7 will be compressed to its maximum. Once this position is passed, the vertical force due to the resilience of the seal 7 supplies the necessary force for finishing the manoeuvre and the stud 15 then abuts against the end of the slot 16 to limit any extra angular movement between the two link rods 13 and 24. This position is shown in continuous lines in FIG. 3. In this position, the housing 3 will be slightly raised in relation to the maximum compression position of the seal 7 but the assembly is dimensioned so that there will be enough remaining compressibility in the seal 7 to exert a vertical force on the pin 26 all the time. Thus, the stud 15 will always be pressed against the end of the slot 16, the link rods 13 and 24 will be stably balanced, the whole housing 3 will always be pressed against the seal 7 even in the event of a breakdown in the cylinder 11.

In other words the articulated bolt is locked in an over-centre locking position.

In this embodiment, four of the devices described hereinabove are used, one in each corner.

When it is required to clamp the housing 3 in the lower position, these four bolts will be operated simultaneously in order to balance the stresses generated.

When each bolt is withdrawn by means of its cylinder 11, the stud 15 abuts against the other end of the slot 16 to prevent the link rod 24 from pivoting too far downwards. This is the position 13' shown in dotted lines in FIG. 3.

The sliding housing 3 has four horizontally operating bolts at its base to ensure lateral clamping of the housing 3 in its lower part in the retracted (rest) position and in the projected (operation) position.

Figure 4:
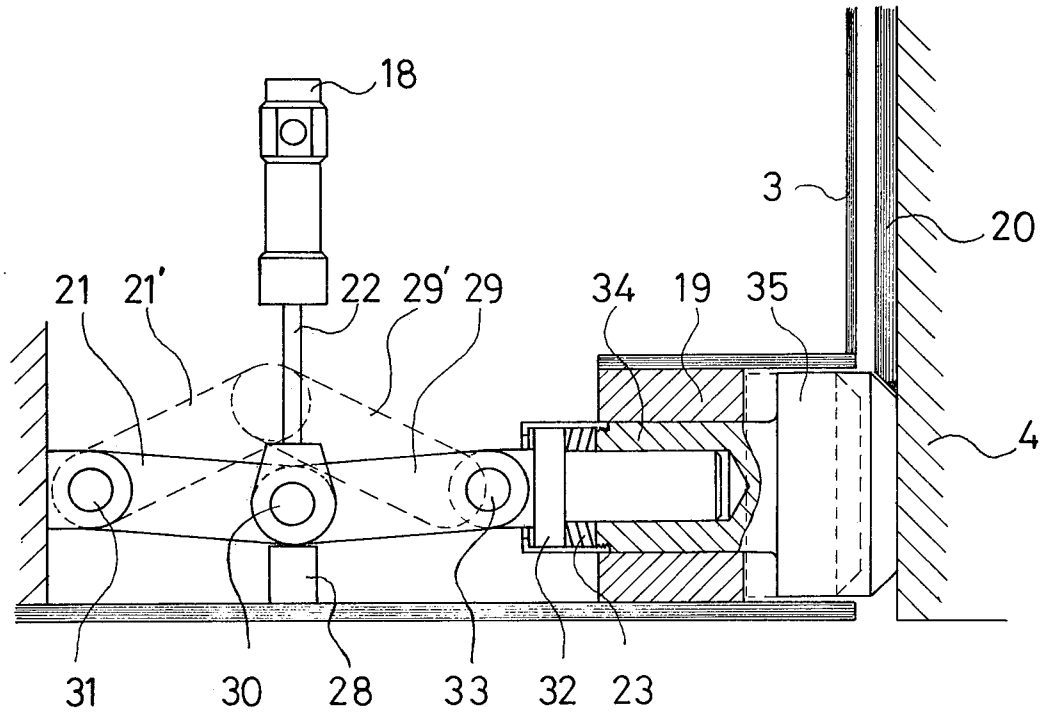
FIG. 4 is a detailed view of a lateral clamping bolt used in the present invention.

FIG. 4 shows one of these bolts which operate on the same principle as horizontal and vertical action bolts.

However, these lower bolts are not completely retractable, for the element which transmits the thrust also acts as a guide shoe during the lowering and retraction operations of the housing 3.

In FIG. 4, two link rods 21 and 29 are articulated on a common axis pin 30, the other end of the link rod 21 being articulated on a joint pin 31 fixed solidly to the structure of the housing 3. The other end of the link rod 29 is articulated on the base of a piston 32 by means of a joint pin 33. The piston 32 is lodged in a bore of a second piston 34 integral with a shoe 35, all these elements being housed in the bore of a cylinder 19 integral with the structure of the housing 3.

By way of a non-limiting example, this mechanism is operated by a double-action hydraulic cylinder 18, whose rod 22 is articulated at its end on the pin 30.

FIG. 4 shows the bolt in dotted lines in the folded position. In this position, the shoe 35 projects slightly from the housing to press against a slide rail 20 during the lowering or raising of the housing.

The housing being in the low position, the cylinder 18 is pressurized to lower its rod 22 and thus to unfold the link rods 21 and 29.

Since the joint 31 is integral with the housing 3, the piston 32 will be pushed towards the outside of the housing and, by means of springs 23, transmits its thrust to the piston 34 and to the shoe 35; this shoe presses against the wall of the recess 4. At this point, the axis of the joint 31, of the axis 30 and the joint 33 will not yet be aligned and to extend beyond this alignment position, the extra movement of the piston 32 in relation to the wall of the well 4 will be absorbed by the springs 23.

Once the alignment position has been exceeded, the horizontal stress due to the resilience of the springs 23 provides the necessary force for finishing the manoeuvre, bringing the link rods 21 and 29 into contact with the stop 28 perpendicular to the axis 30.

The mechanism will then be in the locked position, shown by continuous lines in FIG. 4. The springs 23 still being compressed, the link rods 21 and 29 will be stably balanced, pressed against a stop 28 perpendicular to the axis 30, even in the event of breakdown of a cylinder, Again an over-centre locking position is provided to lock the articulated bolt in a safe position.

In this embodiment, four of the devices described hereinabove are used.

When it is required to clamp the housing 3 in the low position, these four bolts will be operated simultaneously in order to balance the stresses generated.

In this position, the shoes 35 do not undergo any vertical stress because the upper bolts (FIG. 3) and the bearing plane 8 of the seal 7 absorb all the vertical stresses due to the weight or to flotation on of the housing 3.

In the retracted position of the housing, the lower bolts (FIG. 4) will be used to clamp the housing horizontally and, in the case of a breakdown in the main hydraulic cylinders 5, the shoes 35 of these bolts will press vertically against the top of the slide rails 20 to prevent the housing 3 from falling down.

Figures 5, 6, 7:
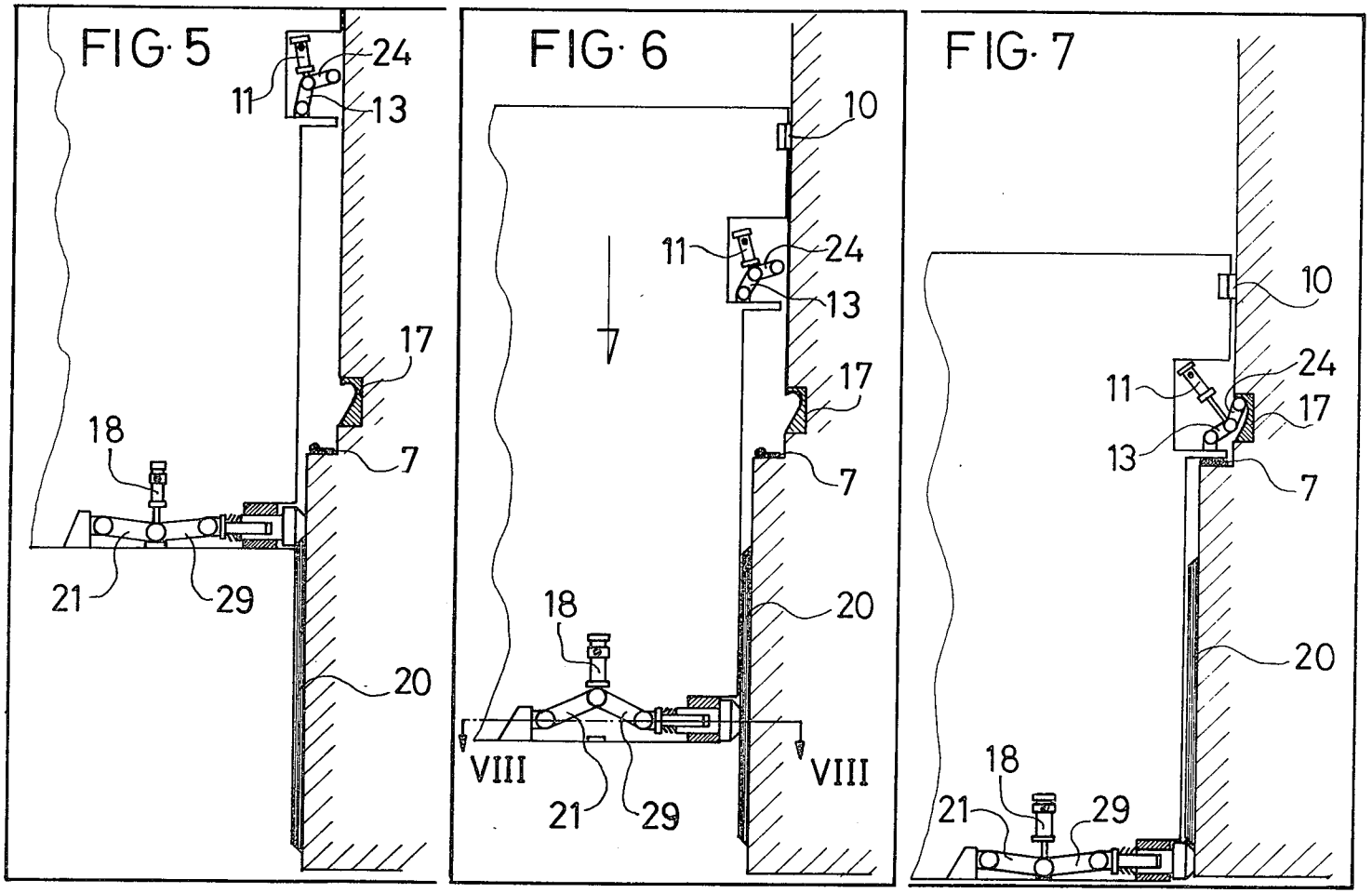
FIG. 5 is a partial cutaway view of the device in the retracted position.
FIG. 6 is a partial cutaway view of the device in an intermediate descending position.
FIG. 7 is a partial cut-away view of the device in the projected operating position.

FIG. 5 shows one of the upper bolts and one of the lower bolts in the retracted position of the propulsion unit 2 (housing 3 in the high position). Since the propulsion unit 2 is in the rest position, sealing is not provided, but lateral clamping of the housing 3 is provided by the cylinders 18 in the locked horizontal thrust position, on the top of the slide rails 20.

It will be seen that the upper and lower locking devices such as described have the following main advantages.

In the case of a breakdown in the operation mechanism (in this case, the hydraulic cylinder), the bolts will still be held in the clamped position the operation of the propulsion device remaining unaffected;

The clamping stresses are great and are obtained with great saving of effort due to the inherent mechanical advantage of the link rod system.

FIG. 6 shows the upper and lower bolts during lowering of the housing 3, the upper bolt remaining in the retracted position, while the lower bolt is in the guide position for lowering and bear against the slide rails 20.

FIG. 7 shows both sets of the bolts in the clamping position, the propulsion unit then being in the operation position, with the propulsion unit 2 projecting below the boat hull.

It is seen that the upper bolts in the operation position clamp the housing against the seal ring 7 as well as providing lateral clamping and that the lower bolts in the operation position ensure lateral blocking against the wall of the well 4.

The housing 3 is thus firmly held in its well 4 and against the seal 7 even in the case of a breakdown of a cylinder 11 or of a cylinder 18.

Figure 8:
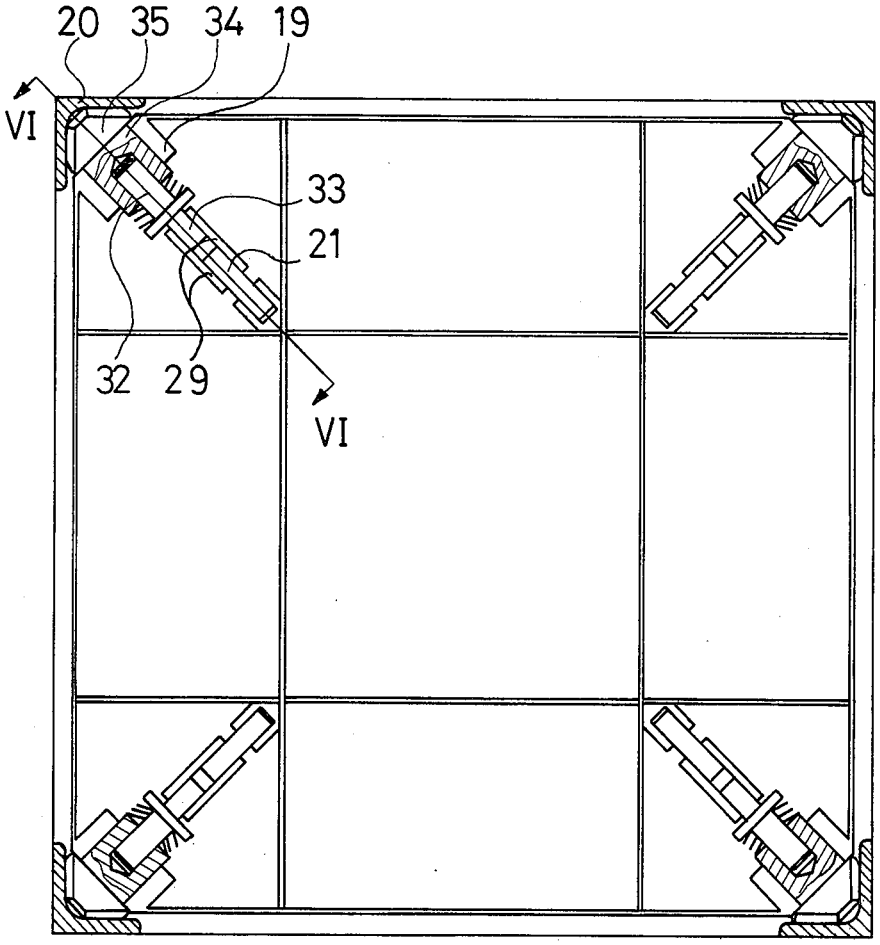
FIG. 8 is a horizontal cross-section view through line VIII—VIII of FIG. 6.

FIG. 8 is a horizontal cross-section of FIG. 6, the housing 3 being lowered and the slide rail 20, the link rods 21 and 29 and the slide shoes 35 thus being visible.

What we claim is:

1. In combination, a motor housing for a water vessel, said vessel having a well for up and down movement of said motor housing therein to permit an associated propulsion unit to be moved between an upper, retracted position with the housing and the propulsion unit inside the well and a lower, operating position with the propulsion unit projecting out of the bottom of the well, the upper part of the motor housing including first clamping means for clamping the housing in the lower, operating position, said first clamping means comprising inclined articulated bolts operatively positioned to engage the walls of the well to provide a force with both a horizontal component and a vertical component, said well including a wall with a shoulder formed therein, the vertical component serving to clamp and seal the housing against said shoulder provided in the wall of the well and the horizontal component serving to hold the upper part of the housing in position in the well against lateral displacement therein, said lower part of the housing including second clamping means for clamping the housing in both the upper and the lower positions, said second clamping means comprising articulated bolts operatively positioned to engage the walls of the well horizontally to hold the lower part of the housing in position in the well against lateral displacement therein.

2. The combination according to claim 1, wherein said articulated bolts are constituted by two interlinked, articulated link rods one of whose ends is articulated to the end of the piston rod of a hydraulic cylinder, the other end of one of the link rods being articulated on a pin whose axis is integral with the housing, the other end of the other link rod being articulated on an axis integral with a thrust member that transmits the thrust to the well.

3. The combination according to claim 2 wherein the articulated bolts further comprise resilient means arranged relative to said thrust member to allow the bolts to be locked in position by the thrust member travelling beyond maximum extension to an over-centre locking position.

* * * * *